US005695105A

United States Patent [19]

Ohara

[11] Patent Number: 5,695,105

[45] Date of Patent: Dec. 9, 1997

[54] APPARATUS FOR CUTTING A WEB AT A PREDETERMINED LENGTH AND SUPPLYING THE SAME

[75] Inventor: Hiromitsu Ohara, Tokyo, Japan

[73] Assignee: Japan Tobacco Inc., Tokyo, Japan

[21] Appl. No.: 219,266

[22] Filed: Mar. 29, 1994

[30] Foreign Application Priority Data

Mar. 31, 1993 [JP] Japan ..... 5-074809

[51] Int. Cl.[6] ..... B26F 3/02; B65H 35/10

[52] U.S. Cl. ..... 225/96; 225/100; 83/162; 83/346; 83/449; 83/678; 226/196; 271/272

[58] Field of Search ..... 225/96, 100, 4, 225/2, 5, 98, 99; 83/162, 331, 332, 346, 347, 447, 449, 450, 678; 271/272, 273, 274, 314; 226/91, 168, 169, 196; 242/526, 527.1, 566, 615.3

[56] References Cited

U.S. PATENT DOCUMENTS

| | | | |
|---|---|---|---|
| 2,420,525 | 5/1947 | Deloye | 255/100 X |
| 2,471,447 | 5/1949 | Perkins | 225/100 X |
| 3,161,335 | 12/1964 | Pine et al. | 225/100 |
| 3,847,318 | 11/1974 | Parenti et al. | 225/100 |
| 3,967,767 | 7/1976 | Seragnoli | 225/100 X |
| 4,022,364 | 5/1977 | Davis | 225/100 |
| 4,118,022 | 10/1978 | Rayfield et al. | 225/100 X |
| 4,131,272 | 12/1978 | Hartnig | 225/100 X |
| 4,397,410 | 8/1983 | Schueler | 225/100 X |
| 4,401,249 | 8/1983 | Kadlecik et al. | 225/100 X |
| 4,577,789 | 3/1986 | Hofmann et al. | 225/100 |
| 4,851,075 | 7/1989 | Parker | 225/100 X |
| 5,076,555 | 12/1991 | Bunch, Jr. | 225/4 X |
| 5,464,142 | 11/1995 | Mol et al. | 225/100 |

FOREIGN PATENT DOCUMENTS

| | | | |
|---|---|---|---|
| 0338260 | 10/1989 | European Pat. Off. . | |
| 1935909 | 6/1970 | Germany . | |
| 3900663 | 7/1989 | Germany . | |
| 199741 | 12/1982 | Japan | 271/272 |
| 7211898 | 3/1974 | Netherlands . | |
| 23859 | of 1913 | United Kingdom . | |
| 1356767 | 6/1974 | United Kingdom | 225/100 |
| 2256828 | 12/1992 | United Kingdom . | |

*Primary Examiner*—Rinaldi I. Rada
*Assistant Examiner*—Clark F. Dexter

[57] ABSTRACT

A cutting roller having cutting blades and a receiving roller are provided downstream of pulling-out rollers for pulling out a web, and the web passing between them is cut. Accelerating rollers rotated at a transmitting speed higher than that of the pulling-out rollers apply a tension to the web. The cutting blades are formed with narrow cutouts, and the receiving roller is provided with narrow annular grooves. Stretched tension guide members extend through the notches and the narrow annular grooves so as to guide the web. The portions of the web corresponding to the notches and the narrow annular grooves are not cut by the cutting blades and are left as uncut portions. However, these portions are broken easily by the tension applied to the web. Since the widths of the cutouts and the annular grooves are very narrow, the torn marks on the broken portions of the web are not remarkable. As the tension guide members extend continuously, the cut end of the web is not caught and is not rolled on the cutting roller.

5 Claims, 3 Drawing Sheets

APPARATUS FOR CUTTING A WEB AT A PREDETERMINED LENGTH AND SUPPLYING THE SAME

BACKGROUND OF THE INVENTION

1. Field of the Invention

The present invention relates to an apparatus for cutting a web at a predetermined length and supplying the cut webs to the following processing apparatus, and more particularly to an apparatus for cutting a continuously supplied web-like packing material in a packing process at a predetermined length and supplying the cut web piece to a packing machine.

2. Description of the Related Art

In general, a packing material used for packing cigarettes has an elongated web-like shape and is wound into a web roll. In the cigarette packing process, the web is continuously pulled out of the web roll and cut at a length corresponding to the length of a pack, and the cut web piece is supplied to a packing apparatus or the like in the next process.

One of the conventional apparati for cutting a web-like material at a predetermined length and supplying the same to the apparatus in the next process cuts off web pieces from the web at predetermined to-be-cut portions at predetermined intervals. The web on this apparatus has cutouts extending crosswise to the web. Each cutout comprises alternating, discontinuous broken line portions and unbroken portions which connect adjacent web portions together so that the web can be continuously pulled out even though it has the cutouts. After having been pulled out, each web portion is moved between two pairs of rollers arranged in tandem in the direction of motion. The transporting speeds of the paired rollers differ from each other. The downstream side pair of rollers rotate at a higher speed than the upstream side pair rollers. Thus, each web portion is applied with a predetermined tension while it moves between these pairs of rollers. The unbroken portions of the cutout are cut off by the tension and the web is cut at the predetermined length at the portion to be cut. The cut-out web portion is supplied to the packing apparatus or the like.

Although this conventional cutting and supplying apparatus has a simple structure, it has the following disadvantage. When a web is made of cellophane or the like, the web is torn away substantially linearly at the unbroken portions of the cutouts resulting in smooth cut-out portions. When, however, a web is made of paper or the like, the unbroken portions at the cutouts are not cut linearly, but are torn irregularly and/or become fluffy. The irregular and/or fluffy cut edges sometimes cause poor operation such as clogging of the web portion in the next process and deteriorates the appearance of a package.

These problems can be prevented by shortening the unbroken portions at each cutout. Since, however, the strength of the unbroken portions of the cutouts is lowered, the unbroken portions of the cutouts are torn away when such tearing-away is not required or desired.

An apparatus housing a cutting mechanism is provided for preventing this problem. When processed on this apparatus, a web is not formed with cutouts. The cutting mechanism comprises a pair of cutting rollers which rotate at a peripheral speed equal to or slightly higher than the transporting speed of the web between which the web passes. A plurality of cutting blades are provided on each cutting roller at predetermined circumferential intervals. The cutting blades are pressed against the web and cut out the web in the predetermined direction.

With this apparatus, every kind of web material can be cut regularly and no irregular cut end is formed. Further, the web material is not cut at a portion not required to be cut upon being pulled out.

This apparatus, however, requires a guide for guiding the web material which is being transported. Naturally, the guide cannot be formed which passes the cutting rollers continuously. If the guide did pass the cutting rollers continuously, the cutting blades of the cutting rollers would not only hit against the guide and be unable to cut the web material but would also break.

In the conventional apparatus, the guide is formed by an upstream guide element and a downstream guide element which are arranged adjacent to each other so as not to interfere with the cutting rollers. These two guide elements substantially form a continuous guide member.

In this arrangement, however, the guide is discontinuous at the portion where the web material is pressed and cut by the cutting rollers. Thus, when the cutting blades cut the web material, the cut end of the web material sometimes adheres to the cutting blades. In this case, the cut end of the web material is moved in the peripheral direction of either one of the cutting rollers and is held in the discontinuous space of the guide. This causes clogging of the cut web material to occur. In some cases, the cut end of the web material is rolled on either one of the cutting rollers in a state in which the cut end adheres to the cutting causing further difficulties.

SUMMARY OF THE INVENTION

The present invention was made with these problems in mind, and the object thereof is to provide a web cutting and supplying apparatus in which a completely continuous web without to-be-cut portions is continuously pulled out from a web roll and cut at a predetermined length and which prevents clogging of web pieces occurring when their cut ends are caught by a guide and rolling of the web pieces on a cutting roller.

In order to achieve the object, a web cutting and supplying apparatus according to the present invention comprises pulling-out means, cutting means, accelerating means and guide means.

The pulling-out means includes a pair of pulling-out rollers which sandwich a web from a web roll as they pull out the web at a predetermined speed. The cutting means is provided downstream with respect to the pulling-out means in view of the transferring direction of the web and comprises a cutting roller and a receiving roller provided and disposed close to the cutting roller. These rollers are rotated in opposite directions. The cutting roller is provided on its peripheral surface with projecting cutting blades arranged at predetermined intervals circumferentially and extending axially out of the cutting roller. The cutting blades are pressed against the peripheral surface of the receiving roller so as to cut the portion of the web which has passed between the cutting and receiving rollers at a predetermined length. At the downstream side of the cutting means there is provided accelerating means which has a pair of accelerating rollers sandwiching the web and sending the web in the transporting direction at a speed slightly higher than the speed which the cutting means provides.

The guide means abuts against both surfaces of the web which has passed through the pulling-out means, cutting means and accelerating means and guides the thus passed web. The guide means has tension guide members each having a small diameter and extending continuously between the cutting roller and the receiving roller of the cutting means in the transmitting direction of the web. Each tension guide member is stretched by a predetermined tension. Each cutting blade is formed with notches for preventing interference of the cutting blade with the tension guide members. Each tension guide member passes through a corresponding notch and is stretched under a predetermined tension. In the peripheral surface of the receiving roller are formed narrow annular grooves for preventing interference of the receiving roller with the tension guide members. The tension guide members pass through corresponding narrow annular grooves and are stretched under a predetermined tension.

The web pulled out from the web roll is transported at a predetermined speed by the pulling-out means. Since the web is cut off by the corresponding cutting blade, the web is ensured to be cut accurately irrespective of the kind of material. Because the tension guide member extends continuously in the transferring direction of the web, the cut end of the web is not caught by the cutting blade and is not rolled on the cutting roller even when the cut end portion adheres to the tip of the cutting blade.

The cutouts and the narrow annular grooves are formed in the cutting blade and the receiving roller. Thus, the web would be not cut by them and uncut portions would be left there. Since, however, the width of the cutouts and of the narrow annular grooves can be made narrow enough because the tension guide members are very thin, the uncut portions of the web are also very narrow. In addition, the web is under tension because of the accelerating means disposed downstream of the cutting means. Thus, the portions which have been uncut are torn easily and the web is cut at the predetermined length. Because of their narrow structure, the edges are smooth and are prevented from being formed irregularly, thereby preventing the cut web from being caught in the next process and/or deteriorating the appearance of the finished product.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment according to the present invention will be described with reference to the accompanying drawings.

Figure 1:
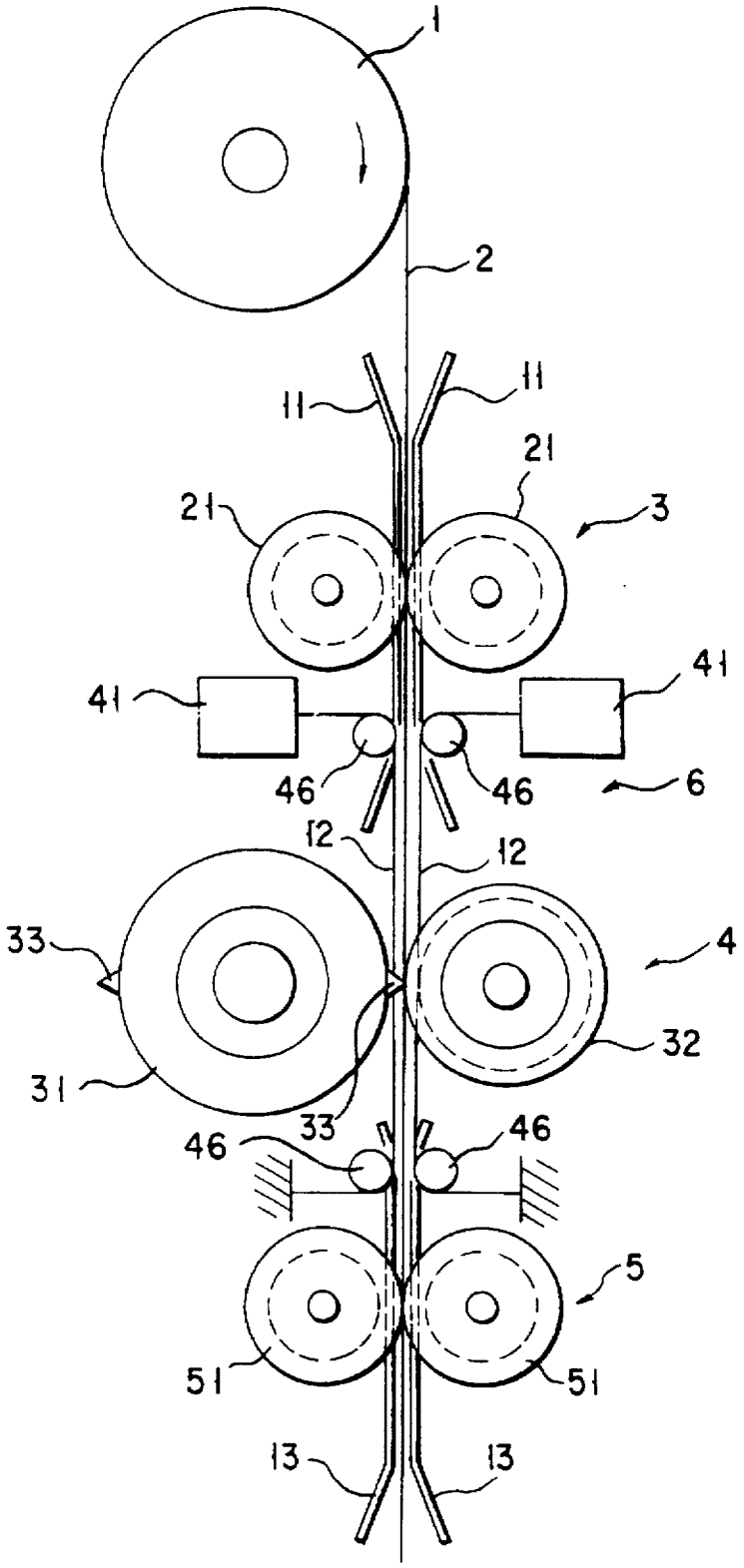
FIG. 1 is a general side view of the overall apparatus of an embodiment according to the present invention.

The embodied apparatus is used for cutting a web for wrapping cigarettes at a predetermined length and supplying the cut web pieces to an apparatus in the next process such as a wrapping machine. A general structure of the apparatus will be described with reference to FIG. 1.

With this apparatus, a web 2 is pulled out from a web roll 1 (formed by winding the web 2) and is supplied to the apparatus in the next process. The web 2 is made of continuous material without to-be-cut portions. The pulled-out portion of the web 2 is transported at a predetermined speed toward the downstream side by cutting means comprising a roller mechanism 3. Cutting roller means comprising a cutting roller mechanism 4 for cutting the transported portion of the web 2 at the predetermined length is provided downstream of the pulling-out roller mechanism 3 (i.e., at the downstream side in view of the transporting direction of the pulled-out web portion). Downstream of the cutting roller mechanism 4 is disposed accelerating means comprising an accelerating mechanism 5 for transporting pulled-out portion of the web 2 at a speed higher than that provided by the pulling-out roller mechanism 3. Guiding means comprising a guide mechanism 6 guides the portion of the web 2 transported through the pulling-out mechanism 3, the cutting roller mechanism 4 and the accelerating roller mechanism 5, and comprises first guide rod members 11, tension guide members 12 made of music wires or the like and second guide rod members 13.

Each mechanism will described. The pulling-out roller mechanism 3 comprises a pair of pulling-out rollers 21 which have peripheral surfaces contacting each other under a predetermined pressure and are rotated around their shaft 22 in the opposite directions at the same peripheral speed. The portion of the web 2 pulled out from the roll 1 is held between the pulling-out rollers 21 and sent downstream at a predetermined speed.

Figure 2:
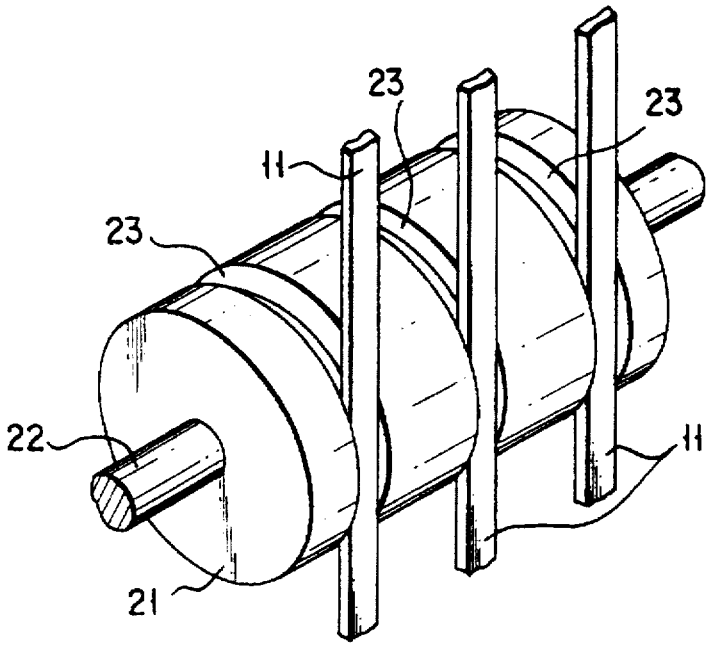
FIG. 2 is a perspective view of a pulling-out roller and parts of guide rod members.

The first guide rod members 11 of the guide mechanism 6 extend in the downstream direction through the pulling-out roller mechanism 3. The first guide rod members 11 extend along the upper surface and the undersurface of the transported portion of the web 2 so that the transported portion of the web 2 is transported on the predetermined path. As shown in FIG. 2, each first guide rod member 11 is an elongated rigid rod.

Referring to FIG. 2, annular grooves 23 for preventing interference of the pulling-out roller 23 with the respective first guide rod members 11 are formed in the peripheral surface of each pulling-out roller 21. The first guide rod members 11 extend continuously through the grooves 23 from the upstream side to the downstream side of the pulling-out rollers 21.

The cutting roller mechanism 4 has a cutting roller 31 and a receiving roller 32 which are disposed at their peripheral surfaces close to each other and are rotated around their shafts 34 and 36 in the opposite directions at the same peripheral speed.

On the peripheral surface of the cutting roller 31 are projectingly provided cutting blades 33 which are arranged circumferentially and extend axially along the cutting roller 31 i.e., crosswise thereof at predetermined intervals. As the cutting roller 31 and the receiving roller 32 are rotated, the cutting blades 33 are pressed against the peripheral surface of the receiving roller 32 and the portion of the web 2 which is passing between the cutting roller 31 and the receiving roller 32 is cut at a predetermined length by the cutting blades 33.

The guide mechanism 6 has the tension guide members 12 disposed at the cutting mechanism 4. The tension guide members 12 are arranged along the front surface and the rear surface of the transported portion of the web 2 similar to the first guide rod members 11. Each tension guide member 12 is made of a thin music wire having a very small diameter, a thin metal strip, an element having a small diameter or thickness and made of material having a high tensile strength, or the like.

One end (the lower end, for example) of each tension guide member 12 is fixed to the fixed side of the apparatus. The other end (the upper end, for example) of the member 12 is connected to a tension control structure 41 and the member 12 is applied with a predetermined tension. Although the tension guide member 12 has a small diameter and is not rigid, it is stretched linearly by the tension so that it functions as a guide member.

Figure 3:
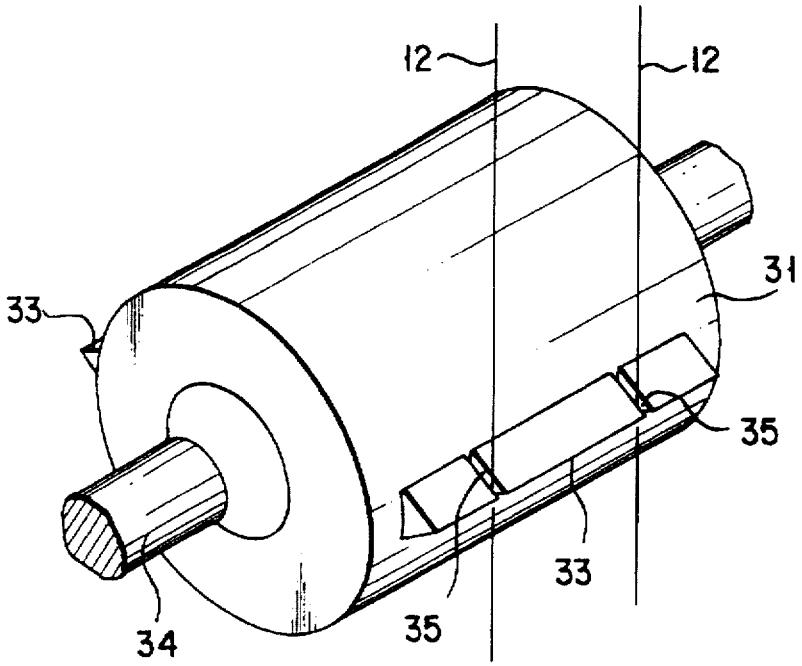
FIG. 3 is a perspective view of a cutting roller and parts of tension guide members.

The tension guide members 12 continuously extend through the cutting roller mechanism 4 from the upstream side to the downstream side of thereof. As shown in FIG. 3, notches 35 for preventing the respective cutting blade 33 from interfering with the tension guide members 12 are formed in each cutting blade 33. The tension guide members 12 continuously extend vertically through the notches 35.

Figure 4:
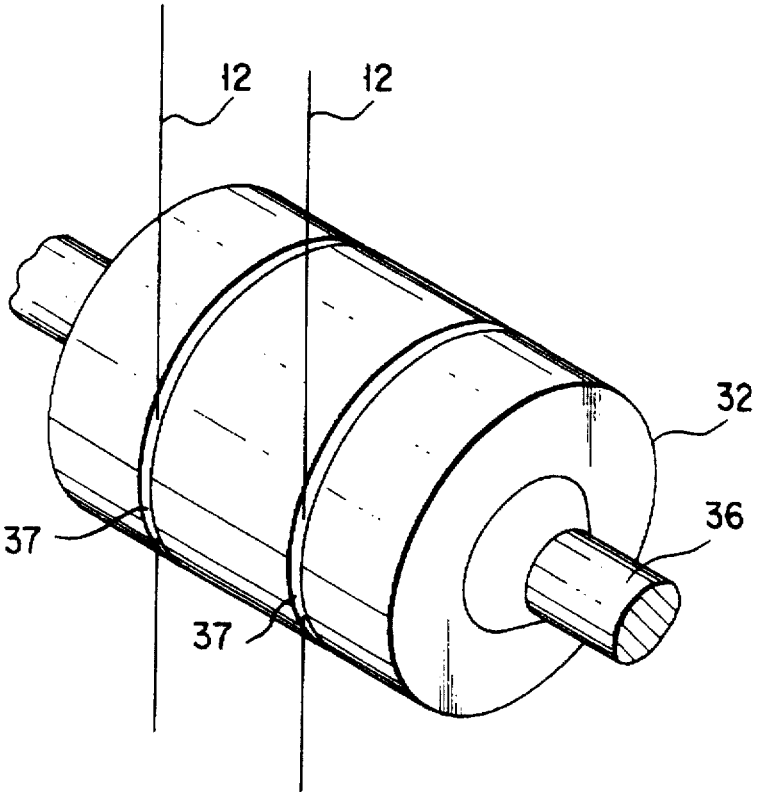
FIG. 4 is a perspective view of a receiving roller and parts of the tension guide members.

As shown in FIG. 4, narrow annular grooves 37 for preventing interference of the receiving roller 32 with the tension guide members 12 are formed in the peripheral surface of the receiving roller 32. The tension guide members 12 continuously extend vertically through the narrow annular grooves 37.

Figure 5:
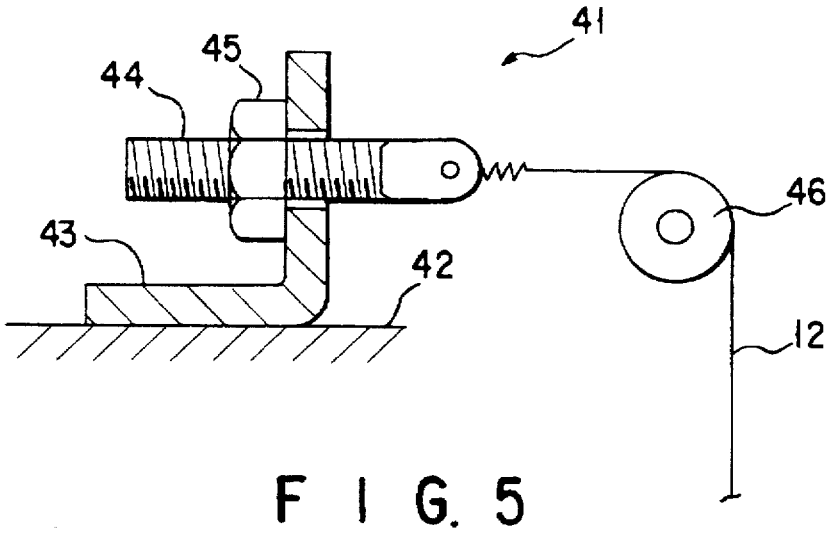
FIG. 5 is a cross sectional view of the main part of a tension adjusting mechanism.

In FIG. 5 is shown an example of the tension control structure 41 having an L-shaped fixture 43 fixed to a member 42 of the fixed side of the apparatus such as a frame. A bolt 44 is screwed to the L-shaped fixture 43 so as to extend therethrough. A nut 45 threadably engages with the bolt 44. Each tension guide member 12 is guided by a pair of guide rollers 46. The tension guide member 12 has one end connected to one end of the bolt 44 and the other connected to the fixed side of the apparatus. The bolt 44 is moved with respect to the fixture 43 by rotating the nut 45 so that the tension guide member 12 is pulled and is provided with predetermined tension. Further, the rotation of the nut 45 adjusts the tension applied to the tension guide member 12.

The accelerating roller mechanism 5 has a pair of accelerating rollers 51. Similar to the first guide rod members 11, the second guide rod members 13 continuously extend vertically through the accelerating mechanism 5 from the upstream side to the downstream side thereof. Annular grooves are formed in the peripheral surface of each accelerating roller 51. The second guide rod members 13 continuously extend vertically through the annular grooves. Since the accelerating roller mechanism 5 has the same structure as the pulling-out roller structure 3, no further detailed description is made.

Alternatively, the tension guide members 12 can extend over the whole area from the upstream side of the pulling-out roller mechanism 3 to the downstream side of the accelerating roller mechanism 5. In this arrangement, the guide rod members 11 and 13 are not required, simplifying the structure of the apparatus, if the following disadvantage is not considered. When the tension guide members 12 are too long, however, their central portions tend to oscillate in resonance with the oscillation of the apparatus. In such an occasion, the central portions of the tension guide members 12 are apt to contact the inner surfaces of the notches of the cutting edges 33 and/or the inner surfaces of the narrow annular grooves 37 of the receiving roller 32, resulting in wear and/or breakage of the tension guide members 12.

In order to prevent this disadvantage, this embodiment employs guide rod members 11 and 13 which have large diameters and are made rigid. The tension guide members 12 cover the minimum region between the upstream side and the downstream side of the cutting roller mechanism 4.

It follows in this arrangement that the tension guide members 12 are shortened so as not to be oscillated by the oscillation of the apparatus. The pulling-out roller mechanism 3 feeds the web 2 by merely holding it and the accelerating roller mechanism 5 accelerates the transporting speed of the web 2 also by merely holding the web 2. In spite of the fact, therefore, that the guide rod members 11 and 13 each having a large diameter pass the mechanisms 3 and 5, the function of the mechanisms 3 and 5 is not deteriorated.

With the accelerating mechanism 5, a transported portion of the web 2 is held between the accelerating rollers 51 and sent downward at a transporting speed higher than that provided by the pulling-out roller mechanism 3. The difference between the two transporting speeds produces a predetermined tension.

The operation of the apparatus according to the present invention will be described. The web 2 is continuously pulled out from the web roll 1 by means of the pulling-out roller mechanism 3 and transported at a predetermined speed. The pulled-out portion of the web 2 is cut at a predetermined length by the cutting roller mechanism 4.

The portions of the web 2 corresponding to the notches 35 of the cutting blades 33 and the narrow annular grooves 37 of the receiving roller 32 are not cut by the cutting blades 33 of the cutting roller 31 but are left as uncut portions. However, the uncut portions of the web 2 are torn as soon as they are formed by the tension produced between the difference of the transporting speeds of the pulling-out roller mechanism 3 and the accelerating roller mechanism 5. Thus, the web 2 is completely cut.

Torn marks are left at the portions of the web 2 which have been torn. However, the notches 35 and the narrow annular grooves 37 have very small widths corresponding to the small diameter of the tension guide members 12, and the length of each uncut portion of the web 2 is very small. Thus, even if the web 2 is made of paper, the torn marks are not so remarkable as deteriorates the appearance of the cigarette package. Further, portions of the web 2 where the torn marks exist are not caught by any elements in the following processes. In this connection, the web 2 is ensured to be cut accurately irrespective of the kind of material of which the web 2 is made.

The tension guide members 12 continuously extend vertically through the cutting roller mechanism 4. Even if the cut end of the web happens to adhere to the cutting blades 33 and is swung laterally, the cut end is not held in the discontinued portions of the guide members as is in the conventional case, and the web 2 is securely guided. Securely guiding of the web 2 also prevents cut end portions of the web 2 from being rolled on the cutting roller 31 in a state in which the cut end adheres to the cutting blades 33.

The present invention is not limited to an apparatus for cutting and supply of packing material of cigarettes but is applicable to a general apparatus for cutting a web at a predetermined length and supplying the same to the next process.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for pulling out a web from a web roll and cutting said web to a predetermined length, comprising:

(a) pulling-out means, comprising at least one pair of pulling-out rollers rotated in opposite directions at a first transporting speed, for holding therebetween the web pulled out from the web roll and transporting the web in a transporting direction;

(b) cutting means for cutting the web including:

a cutting roller and a receiving roller disposed close to each other and downstream of said pulling-out means, said cutting roller having a peripheral surface and said receiving roller having a peripheral surface; and axially extending cutting blades provided on the peripheral surface of said cutting roller, for pressing against the peripheral surface of said receiving roller and cutting said web passing between said cutting roller and said receiving roller into a web piece having a predetermined length and two surfaces;

(c) accelerating means, comprising at least one pair of accelerating rollers provided downstream of said cutting means, rotated at a second transporting speed higher than the first transporting speed of said pulling-out rollers, for sandwiching and transporting the web piece in said transporting direction;

(d) guide means for guiding the web piece including a plurality of tension guide members continuously extending under a predetermined tension from a downstream side of said pulling-out means to an upstream side of said accelerating means along both surfaces of the web piece, and through said cutting means, said tension guide members having a width;

(e) said cutting blades including notches through which some of said tension guide members pass for substantially preventing said cutting blade from interfering with said tension guide members, said notches having a width which substantially corresponds to the width of said tension guide members wherein the width of said notches results in uncut portions on the web;

(f) said receiving roller including annular grooves provided on the peripheral surface thereof through which another of said tension guide members pass for substantially preventing said receiving roller from interfering with said tension guide members.

2. The apparatus according to claim 1, said guide means further comprising guide rod members having a relatively large width with respect to said tension guide members, said guide rod members including first guide rod members passing through said pulling-out means and second guide rod members passing through said accelerating means.

3. The apparatus according to claim 1, wherein each of said tension guide members comprises a flexible wire.

4. The apparatus according to claim 1, further comprising a tension control mechanism, attached to said tension guide members, for applying a tension to said tension guide members.

5. The apparatus of claim 4, wherein said tension control mechanism comprises a means for adjusting the tension applied to said tension guide members.

* * * * *